US005427746A

United States Patent [19]

Pereira et al.

[11] Patent Number: 5,427,746

[45] Date of Patent: Jun. 27, 1995

[54] FLOW MODIFICATION DEVICES FOR REDUCING EMISSIONS FROM THERMAL VOC OXIDIZERS

[75] Inventors: Carmo J. Pereira, Silver Spring, Md.; Rodney J. Schwartz, Green Bay, Wis.

[73] Assignee: W. R. Grace & Co.-Conn., New York, N.Y.

[21] Appl. No.: 207,764

[22] Filed: Mar. 8, 1994

[51] Int. Cl.[6] ..... F01N 3/24; F23D 11/44

[52] U.S. Cl. ..... 422/177; 422/176; 422/180; 422/201; 422/203; 431/5; 431/7; 431/215; 110/210; 110/214

[58] Field of Search ..... 422/171, 176, 177, 180, 422/201, 203, 204; 60/299, 301; 110/210–212; 431/5, 7, 170, 215, 207

[56] References Cited

U.S. PATENT DOCUMENTS

| | | | |
|---|---|---|---|
| 3,808,806 | 5/1974 | Nakamura | 60/301 |
| 3,854,288 | 12/1974 | Heitland | 60/301 |
| 3,947,545 | 3/1976 | Ishida | 60/301 |
| 4,318,894 | 3/1982 | Hensel et al. | 422/177 |
| 4,725,411 | 2/1988 | Cornelison | 422/180 |
| 4,820,500 | 4/1989 | Obermüller | 110/210 |
| 4,850,857 | 7/1989 | Obermüller | 431/5 |
| 4,991,396 | 2/1991 | Goerlich et al. | 431/5 |
| 5,150,573 | 9/1992 | Maus et al. | 422/171 |
| 5,209,062 | 5/1993 | Vollenweider | 422/177 |
| 5,320,523 | 6/1994 | Stark | 431/5 |

*Primary Examiner*—Robert J. Warden
*Assistant Examiner*—Hien Tran
*Attorney, Agent, or Firm*—Beverly J. Artale

[57] ABSTRACT

A method and apparatus for reducing the emissions from a thermal oxidizer for volatile organic compounds (VOC) containing waste gases. The waste gas is treated in a thermal reactor and either before, in or after the thermal reactor the waste gas is contacted with a catalyzed surface device in the gas stream within the thermal oxidizer. The catalyzed surface device has a catalyzed surface which contacts the waste gas and further oxidizes the waste gas.

6 Claims, 3 Drawing Sheets

FLOW MODIFICATION DEVICES FOR REDUCING EMISSIONS FROM THERMAL VOC OXIDIZERS

BACKGROUND OF THE INVENTION

1. Field of the Invention

This invention relates to the use of improved flow modification devices for use with Volatile Organic Compounds (VOC) emission control equipment.

Flow distribution devices can be the key to the efficient operation of chemical processing equipment such as contactors and reactors, mixers, burners, heat exchangers, extrusion dies, and even textile-spinning chimneys. To obtain optimum distribution, proper consideration must be given to flow behavior in the distributor, flow conditions upstream of the distributor, and flow conditions downstream of the distributor. Guidelines for the design of various types of fluid distributors are provided in the literature, e.g., see Chemical Engineers Handbook, R. H. Perry and C. H. Chilton, eds., Fifth Edition, McGraw Hill, Pages 5–47 to 5–49.

Flow distributors are employed in thermal VOC incineration systems both for thermal energy management and for controlling emissions. Several different types of flow distributors may be used. Examples of possible locations for installation of distribution devices, shown in FIGS. 1 and 2, include:

(i) The Flame Tube (Location 1): More efficient combustion of VOCs is typically obtained by increasing temperature, turbulence, and the residence time of the VOCs within the reaction chamber. Unfortunately, increased temperature also accelerates the thermal oxidation reaction between nitrogen and oxygen, thereby forming undesirable nitrogen oxides that contribute to environmental problems such as ozone formation and acid rain. Static mixers, usually characterized by a high void fraction, may be used to improve mixing within the flame tube. Improved mixing will typically enhance the destruction of VOCs and decrease NOx and CO emissions. Mixers are commercially available from several manufacturers including the Static Mixing Group of Koch Engineering Company, Wichita, Kans., and Kenics Static Mixers, Chemineer, Inc., North Andover, Mass.

(ii) Turning Vanes (Location 2 and 3): Vanes may be used to improve velocity distribution and to reduce friction loss in bends. For a miter bend with low velocity flows, simple circular arcs can be used. Vanes of special airfoil shapes may be required for high-velocity flows. For a sweep bend, splitter vanes are used. These vanes are curved vanes extending from end to end of the bend and dividing the bend into several parallel channels.

(iii) Perforated Plates and Flow Straighteners (Location 4): These are used for achieving flow uniformity by adding sufficient uniform resistance. Flow straighteners can include monolithic structures or a bed of solids. The degree of flow uniformity achieved via flow straighteners is related to pressure drop by relationships discussed in the literature (e.g., see Perry). Flow straighteners can be optimally located in the heat exchanger section of the thermal oxidation system to maximize heat recovery.

The object of the present invention is to incorporate catalytically-active flow modification devices into thermal oxidation systems so as to achieve both flow modification and VOC and CO emission reductions. An additional benefit may be operation of the combustor at a lower temperature. This could potentially reduce NOx emissions and permit the use of lower grade X alloy steels.

The maximum catalytic oxidation conversion is determined by the mass transfer-limited performance of the catalyzed flow modification device according to the relationship $$-\ln(1 - X) = \frac{k_m S}{Q} \tag{1}$$

where X is the fractional conversion, $k_m$ is the external mass transfer coefficient, S is the total geometric surface area and Q is the volumetric flow rate of exhaust gas. Correlations for $k_m$ as a function of the Reynolds and Schmidt numbers are available in the literature (e.g., Fundamentals of Momentum, Heat and Mass Transfer, John Wiley & Sons, 1976, page 589).

Equation 1 suggests that the catalytic conversion of the oxidation system can be increased by increasing the catalytically-active surface area of the flow modification device (S), the external mass transfer coefficient ($k_m$), or by decreasing the flow rate of the exhaust (Q).

S may be increased by either increasing the geometric surface per unit volume of the device and/or by increasing the volume of the device. Increasing geometric surface area per unit volume typically results in increased pressure drop. Such an option can be implemented in the case of a flow straightener. Increasing the volume of the device is an option in the case of flow distribution devices, e.g., mixers or turning vanes. The coefficient $k_m$ primarily depends on the local velocity and the hydraulic radius of flow. As discussed above, $k_m$ is obtained from literature correlations.

The performance of the device can only approach the conversion predicted by equation (1) if the catalytic layer is highly active under conditions of operation. High activity may be obtained by the use of noble or base metal catalysts as practiced in the art. Another option is to fabricate the device using a metal having catalytic activity. Examples of such metals are Cr and Ni-containing stainless steels. Such steels could also be aluminized to form a surface alloy layer which is later activated by chemicals and treated to form a catalytically active surface.

Catalytic activity can also be increased by placing the device at a temperature that is high enough to increase the catalytic reaction rate but not high enough to irreversibly deactivate the catalyst or structurally damage the flow device. The catalyst could be placed in the flame tube to light off the oxidation reactions. Complete oxidation of VOCs can be accomplished either across the catalyst or by a combination of catalyst and subsequent homogeneous gas phase reactions. The latter concept is referred to by those in the art as catalytic combustion.

2. Description of the Previously Published Art

Air flow management is a key to the efficient operation of thermal oxidizers for controlling Volatile Organic Compound (VOC), carbon monoxide (CO) and nitrogen oxide ($NO_x$) emissions. Flow modification devices (e.g., mixers, flow straighteners, flow diverters, etc.) are being used in the art to maximize both conversion of VOCs in the combustion chamber and heat recovery in the recuperative or regenerative heat exchanger. Two possible types of recuperative thermal oxidation systems conventionally used for VOC destruction are shown in FIG. 1 and 2.

A conventional thermal oxidizer operates at temperatures in excess of 1,400° F. and converts over 99% of the VOCs; however, the exhaust can contain $NO_x$ (formed in the burner) and CO (a product of incomplete combustion). Environmental regulations are requiring increasingly stringent controls on VOC, CO and $NO_x$ emissions. For example, European regulations are requiring the control of VOC levels below 20 mg/Nm$^3$, and control of CO and $NO_x$ levels below 50 mg/Nm$^3$.

U.S. Pat. No. 3,917,811 teaches fluid management by static mixers which may be formed of catalyst coated materials (col. 2, line 3). The process is broadly directed to producing a "physiochemical change of (the) state of interaction between a fluid and a material which is physiochemically interactive with such fluid". The mixing device described comprises a conduit which contains a plurality of curved sheet-like elements extending longitudinally through the conduit and in which consecutive elements are curved in opposite directions. An example given for the use of the device is the removal of $SO_2$ from air using water. It is claimed that the patented structure provides improved gas-liquid contacting compared with other conventional materials (such as ceramic Raschig rings) used in packed bed columns. The patent does not discuss the application of catalyst-coated flow modifiers for the gas phase oxidation of VOCs from industrial plant exhausts, the apparatus does not utilize a thermal oxidizer, nor does the patent specify the parameters required for efficient mixing and destruction of the VOCs.

U.S. Pat. No. 4,318,894 is directed at catalytic purification of exhaust gases and which teaches the concept of coating a flow modifying component of a catalytic purifier with a catalytic mass (see col. 2, line 27 and claim 9,). This patent describes an apparatus for the catalytic purification of exhaust gases from combustion engines of motor vehicles comprising a customary metal automobile exhaust pipe the dimensions of which do not vary along the length and which does not contain any special housings or canisters for catalysts. Further, the exhaust pipe contains flow interrupting baffle surfaces which are secured to metal ribbons mounted at one or several points inside the pipe. The exhaust pipe is mounted between the exhaust outlet of the engine and the muffler and is the sole means for control of pollutants from automobile exhausts. This patent does not address the special needs of processes for destruction of VOCs emitted from industrial plants, nor does the apparatus have a thermal burner.

U.S. Pat. No. 5,150,573 relates to a catalyst arrangement, particularly for internal combustion engines, having a diffusor widening in the flow direction preceding a honeycomb-like catalyst body and a converger, narrowing in the flow direction, following the catalyst body. A flow guide is placed in between the diffusor and the converger and the surfaces of the flow guide are coated with catalytic active material (col. 4, line 25). The device of the present invention does not include converger or diffusor components and is, as will be discussed later, particularly suited for VOC control.

U.S. Pat. No. 5,209,062, is directed to a diesel engine having in its exhaust manifold, a static mixer coated with catalytic material (col. 3, line 17). In addition, nozzles are provided in an annular chamber between the static mixer and the exhaust manifold in order to introduce a reducing agent into the flow of exhaust gas prior to entry into the static mixer. This apparatus is particularly suited for diesel engine applications and, due to the compositional requirements of the exhausts, is not suitable for VOC destruction.

U.S. Pat. No. 4,725,411 discusses a fluid treating device for carrying out chemical and/or physical reactions in a flowing stream in contact with a stationary corrugated thin metal member. The converter comprises a housing and a fluid inlet and outlet, indicating that the device is a stand-alone system for conducting physical and/or chemical reactions. The converter contains a metallic foil having zig-zag corrugations which is folded back and forth on itself into the converter as an accordion. Fluid flows through the spaces between alternate layers of foil. Catalytic washcoats may also be coated on the metallic foil and the device is useful as a catalytic converter. The device is also proposed for use as a particulate trap, especially for diesel engine applications. The above device is not proposed for use as an integral part of thermal VOC oxidizer system nor is its proposed use for fluid flow modification.

3. Objects of the Invention

It is an object of this invention to improve the performance of an emission control device such as a thermal oxidizer by using modification devices for reducing temperature and flow maldistribution within the device.

It is a further object of this invention to use flow modification devices that reduce emissions of pollutants such as VOCs, CO and $NO_x$ from thermal oxidizer exhausts. The materials of construction for these devices will withstand the local operating conditions and reduce CO and VOC emissions.

It is a further object of this invention to use flow modification devices that are coated with a catalytically active layer. Catalytic ingredients can include noble metal or base metal oxides dispersed on a high surface area mixed oxide support.

It is a further object of this invention to properly select and position these flow modification devices within the thermal oxidizer to reduce stack emissions of VOCs and CO.

These and further objects will become apparent as the description of the invention proceeds.

SUMMARY OF THE INVENTION

Improved performance of thermal oxidizers is obtained by incorporating catalytically-active flow modification devices into the thermal oxidizer apparatus. Examples of these flow modification devices include, but are not limited to, turning vanes, flow mixers, flow straighteners, and flow diverters. The flow modifiers of the present invention reduce emissions of residual VOC and CO in the burner and/or combustion chamber, or in subsequent heat exchange equipment.

The apparatus for thermally oxidizing waste gases with reduced emissions has a gas inlet to which the waste gas stream to be oxidized is supplied. The gas inlet is connected to a reactor for thermally oxidizing the waste gas stream. The reactor preferably has either a pre-mix burner or a nozzle-mix burner to thermally oxidize the waste gas stream. The reactor is connected to an exhaust outlet for releasing the oxidized gas from the apparatus. Positioned between the gas inlet and the exhaust outlet are catalyzed surface devices such as the flow modification devices discussed above which contact the waste gas and further oxidize the waste gas.

In the preferred embodiment where the catalyzed surface area is S and the volumetric flow rate of waste gas passing through the device is Q, the ratio of Q/S is at least 0.025 ft./sec.

The method for reducing the emissions of VOC containing waste gases from a thermal oxidizer involves treating the waste gas in a thermal reactor and additionally contacting the waste gas either before, in, or after the thermal reactor with a catalyzed surface device in the gas stream within the thermal oxidizer apparatus. The catalyzed surface device has a catalyzed surface which contacts the waste gas and further oxidizes the waste gas.

BRIEF DESCRIPTION OF THE DRAWING

FIGS. 1 and 2 are illustrations of thermal oxidizers that may contain the flow modification devices of this invention.

DESCRIPTION OF THE PREFERRED EMBODIMENTS

Figure 1:
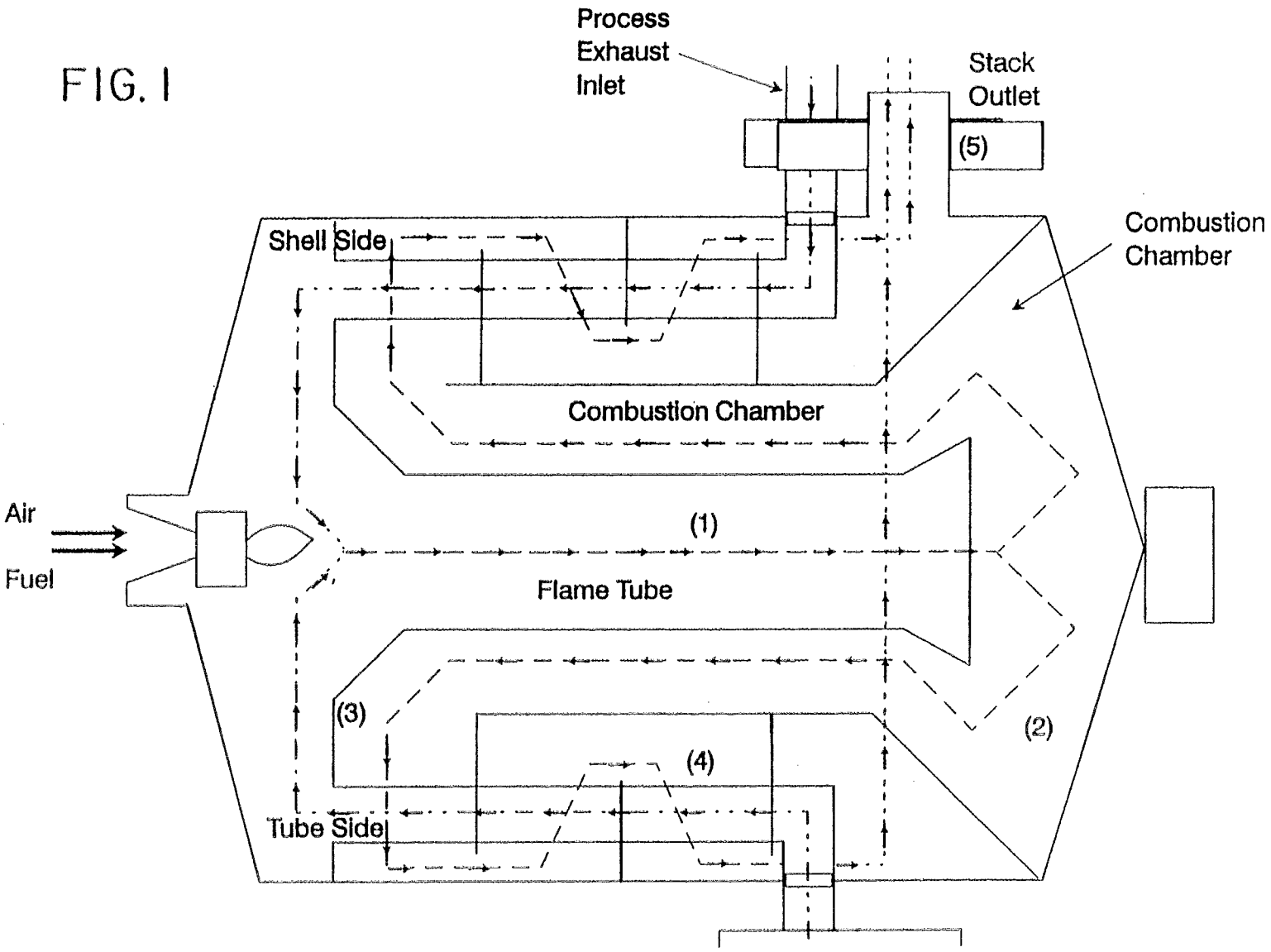
FIG. 1 is a schematic drawing of an annular thermal oxidizer containing an annular recuperative heat exchanger.

The novelty of the present invention is illustrated for a mixer and flow straightener. Such devices may be placed prior to or after the recuperative heat exchanger. For example, the flow straightener may comprise a corrugated metal foil that is folded back on itself to form a monolith structure. A pressure drop of 1 to 5" of water column across the device is generally sufficient to obtain uniform flow through the heat exchanger.

Incorporation of a catalytically-active flow modifier can result in the following two advantages. First, the average combustion chamber temperature may be reduced from above 1,400° to 700°-1,000° F., resulting in lower $NO_x$ emissions from the burner. Secondary economic benefits may be (a) the use of lower-grade stainless steels in the combustion chamber (i.e., lower capital costs), and (b) lower fuel usage (i.e., lower operating costs).

Second, the VOC may be converted to CO in the combustion chamber. CO and unconverted VOCs are then converted to $CO_2$ across the flow straightening device. The exothermic heat of reaction liberated in the burner zone by the conversion of the VOC to CO is 50 to 65% of the total heat that would be liberated in the conversion of the VOC to $CO_2$ (which is the preferred product of reaction in thermal oxidizers). As stated in the first advantage above, conversion to CO may reduce the peak temperature in the burner flame thereby reducing $NO_x$ formation. Further, heat liberated in the flow straightener from conversion of CO to $CO_2$ may be more efficiently recovered by positioning the flow straightener at an optimal location prior to or in the heat exchanger.

The overall impact of the invention is that the thermal oxidizer-based emission control system will have lower emissions control system will have lower emissions of VOC, CO and $NO_x$ for a given operating temperature.

Thermal burners are used in VOC oxidation equipment to increase the average temperature of the VOC-laden exhaust. The main purpose of the burner is to facilitate thermal oxidation of VOCs. Thermal oxidation can also occur in other types of apparatus, e.g., stationary and mobile (automobile or diesel) engines. The purpose of combustion in these devices, however, is to generate reliable power and not to reduce pollutant emissions.

Burners used in oxidation equipment are typically fired by raw natural gas. There are several types of burner designs used in the industry. Two important classes of burners are (a) premix burners, and (b) nozzle burners.

Premix burners burn by hydroxylation and are used for natural-draft applications and for forced-draft applications when controlled exhaust conditions are required. Several high velocity burners, though not strictly premix burners, produce temperatures and mixing similar to premix burners (e.g., see Perry). In premix burners, the rate of flame propagation must be exceeded to assure that ignition cannot travel back into the burner. Flow mixing devices can sometimes be used to stabilize the flame and prevent the flame from travelling into the burner.

Nozzle-mix burners mix air and gas at the burner tile. The burner may be a standard forced-draft register with the gas emitted from holes drilled in the end of a supply pipe. While easy to build, the large holes in these burners can cause gas mixing problems; these burners frequently produce a luminous gas flame. Small-diameter pipe can be inserted at the center of the burner or large-diameter rings can extend to the outside of the burner tile. These rings can use very small holes and give better dispersion of gas in the air, though they can plug up easily. Burners can alternatively have spiders located in the burner inlet and through which gas is emitted in all the several radial arms. The spider is drilled to emit gas from the sides of the bars to provide a reaction from emission of the high pressure gas, causing the spider to turn. The spider can be attached to a fan so that forced draft is provided by the movement of the spider. The spider arrangement provides high turbulence for close regulation of excess air.

The flow modification devices of this invention may be placed after the burner at the various locations 1, 2, 3, 4, 5 shown in FIGS. (1) and (2). Examples are provided of mixing devices and flow straighteners. The materials of construction can include suitable stainless steels (e.g., containing Cr) or steels coated with a catalytically-active layer. Catalysts used can include noble metals (e.g., Pd, Pt, Rh, Re, etc.) and base metal oxides (e.g., Cr, Cu, V, W, Mo, Mn, perovskites, zeolites, etc.) either supported or in combination with high surface area inorganic oxides (e.g., alumina, silicas, clays, etc.) and binders (e.g., aluminum chlorohydrol, silica and alumina sols, acid-peptized mixed oxides, etc.).

Having described the basic aspects of the invention, the following examples are given to illustrate specific embodiments thereof.

Example 1

A 33.8" diameter, 7.9" deep mixer made of a lean austenitic heat resistant alloy RA Z53MA manufactured in Sweden by Avesta Corporation and having a nominal chemical composition of

| Element | % Composition |
|---|---|
| Nickel | 11 |
| Chromium | 21 |

-continued

Figure 3:
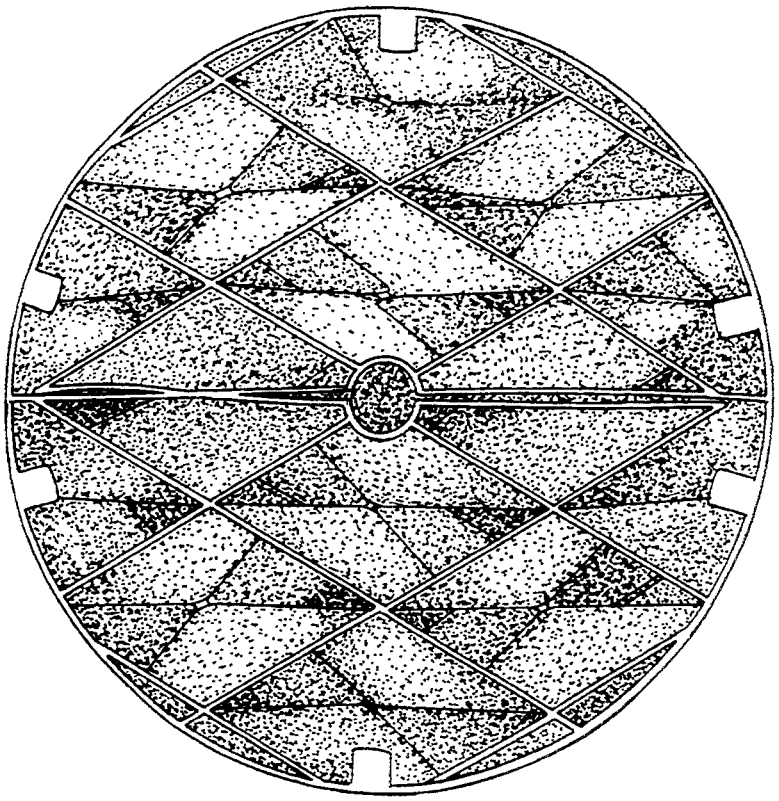
FIG. 3 is a photograph of a flow mixer device.

| Element | % Composition |
|---|---|
| Manganese | 0.6 |
| Silicon | 1.7 |
| Carbon | 0.08 |
| Nitrogen | 0.17 |
| Cerium | 0.04 |
| Iron | 65 |

was installed at location 1 in a 33.8" diameter flame tube of 21,772 scfm thermal oxidizer similar to that shown in FIG. 1. The geometry of the 8 rows of turning vanes in the mixer is shown in FIG. 3. The geometric surface area of the mixing device (S) was 443 ft.$^2$. Thus, according to Equation 1, the ratio of Q/S is 0.82 ft./sec. The mixer was installed into the flame tube and the following results were observed:

(1) Flame tube temperature stratification was reduced from greater than 250° F. without the mixer to less than 40° F. with the mixer. The pressure drop across the mixer was 10" water column at full flow.

(2) Prior to mixer installation, CO emissions oscillated between 150 and 320 ppmv with several CO spikes of over 400 ppmv. These variations were believed due to (1) above, inadequate burner control, and damper flow transients. Burner controller tuning together with installation of the mixer reduced CO emissions to the 40 to 80 ppm range during "run" mode, and less than 300 ppmv during the damper flow transients.

Example 2

Figure 2:
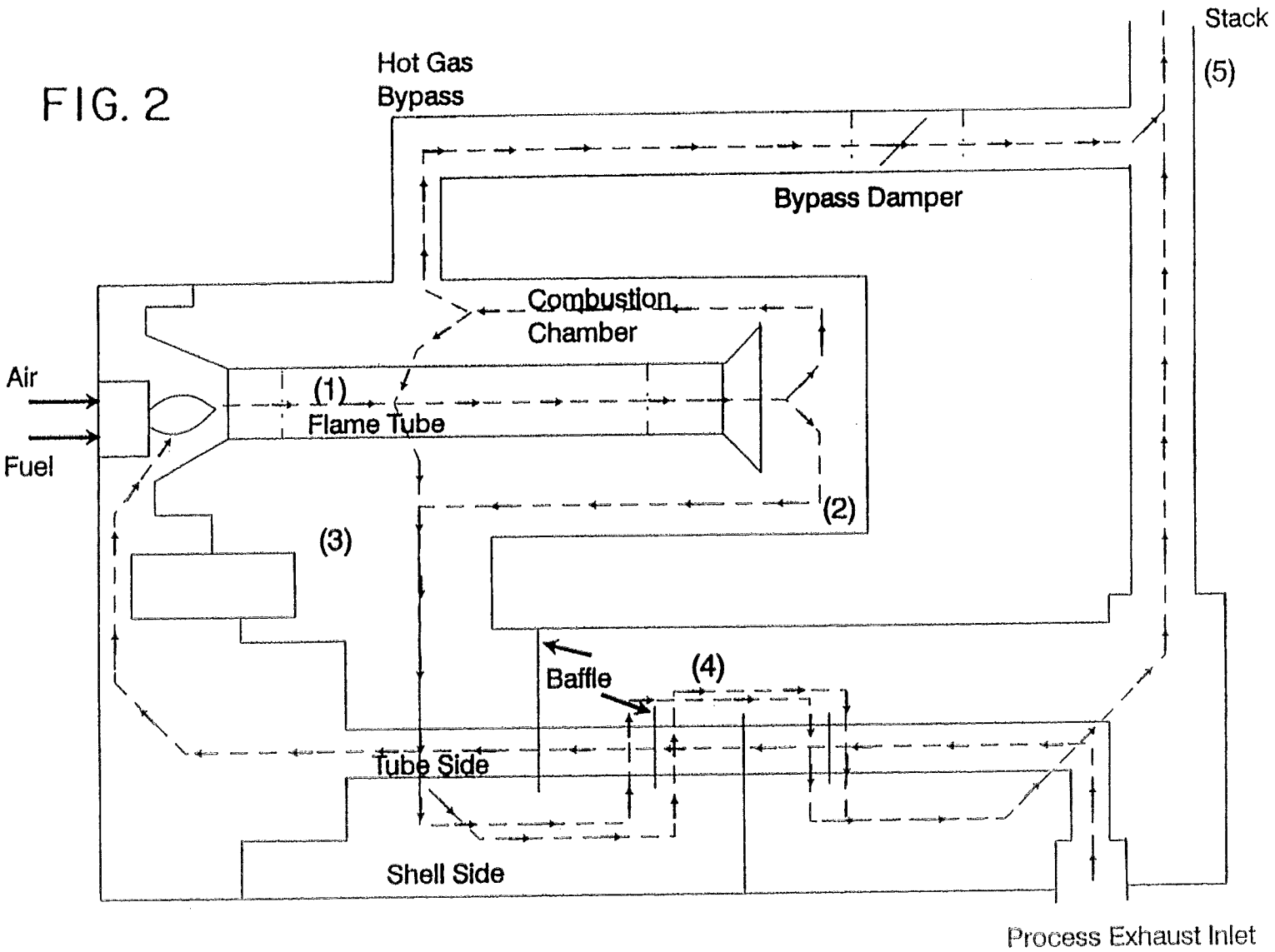
FIG. 2 is a schematic drawing of an annular thermal oxidizer containing a non-annular recuperative heat exchanger.

A flow straightening device with cross-sectional area of approximately 7.4 ft.$^2$ and 3.5" deep was installed at location (3) in a 9,500 scfm thermal oxidizer similar to that shown in FIG. 2. The structure of the flow straightener was similar to that discussed in U.S. Pat. No. 4,725,411. The surface of the flow straightener was coated with a layer of catalyst containing noble metals impregnated on a 26% ceria, 74% stabilized alumina support. The loading of noble metals was 40 g/ft.$^3$ of catalyst, with a Pt to Pd ratio of 3. The geometric surface area of the mixing device was 1430 ft.$^2$. Thus, according to Equation 1, the ratio of Q/S is 0.11 ft./sec.

The flow straightener was installed and the performance of the thermal oxidizer was monitored as a function of heat input for a 9,500 scfm exhaust flow containing heptane VOC (expressed at 3,000 ppm of $C_1$). The concentration of VOC, CO and NOx was monitored before the burner, after the burner (or before the flow straightener), and after the flow straightener as shown in Table 1. As shown in Table 1, significant reductions in the levels of CO and VOC are achieved by the catalytically-active flow straightener.

TABLE 1

Thermal Oxidizer Performance for Heptane Oxidation[A]

| No. | Inlet VOC (ppm) | Burner Inlet Concentration (ppm) VOC | CO | $NO_x$ | Burner Outlet Concentration (ppm) VOC | CO | $NO_x$ | Avg. Inlet Temp to Flow Straightener (°F.) | Flow Straightener Outlet Concentration (ppm) VOC | CO | $NO_x$[B] |
|---|---|---|---|---|---|---|---|---|---|---|---|
| 1 | 2970 | 2961 | 49 | 0 | 2430 | 156 | 8 | 598 | 720 | 26 | 8 |
| 2 | 2862 | 2568 | 93 | 0 | 1176 | 417 | 7 | 699 | 335 | 21 | 7 |
| 3 | 3150 | 2754 | 103 | 5.8 | 1992 | 426 | 18.2 | 800 | 250.5 | 29 | 18 |
| 4 | 2901 | 2400 | 132 | 7 | 1779 | 420 | 17 | 899 | 231 | 41 | 17 |
| 5 | 3210 | 2740 | 96 | 5 | 1998 | 353 | 16 | 996 | 260 | 31 | 16 |
| 6 | 3063 | 2493 | 118 | 5 | 1503 | 590 | 22 | 1096 | 130.5 | 34 | 22 |
| 7 | 3000 | 1932 | 207 | 4 | 300 | 1360 | 14 | 1200 | 33 | 31 | 14 |
| 8 | 3000 | 2130 | 206 | 0 | 111 | 1424 | 17 | 1250 | 16 | 62 | 17 |
| 9 | 3000 | 184 | 243 | 0 | 20 | 1218 | 19 | 1300 | 13.2 | 22 | 19 |
| 10 | 3000 | 1920 | 248 | 0 | 2 | 480 | 18 | 1350 | — | — | 18 |
| 11 | 3000 | 1233 | 310 | 0 | 0 | 48 | 18 | 1400 | — | — | 18 |
| 12 | 3000 | 1410 | 436 | 0 | 1 | 15 | 19 | 1450 | — | — | 19 |

[A]Heptane concentration is expressed at ppm as $C_1$.
[B]$NO_x$ concentration assumed unchanged across straightener.

The reduction of CO and VOC across the catalytically-active flow straightener is quantified in Table 2 for a range of inlet temperatures. A shown in Table 2 for the first 8 runs in Table 1, reduction of CO in the 83 to 98.5% range and reduction of VOCs in the 70 to 95.5% range are obtained from the burner outlet concentrations.

TABLE 2

Flow Straightener Catalytic Performance
(Flow = 9950 scfm; VOC = 3000 ppm heptane as $C_1$)

| Inlet Temperature (°F.) | Conversion (%) VOC | CO |
|---|---|---|
| 598 | 70.4 | 83.3 |
| 699 | 81.1 | 94.9 |
| 800 | 87.4 | 93.2 |
| 899 | 87.0 | 90.2 |
| 996 | 87.0 | 91.2 |
| 1096 | 91.3 | 94.2 |
| 1200 | 92.3 | 97.9 |
| 1250 | 85.0 | 96.1 |
| 1300 | 95.5 | 98.5 |

It is understood that the foregoing detailed description is given merely by way of illustration and that many variations may be made therein without departing from the spirit of this invention.

What is claimed is:

1. An improved apparatus for thermal oxidation of oxidizable substances in waste gas from industrial plants, wherein the apparatus comprises: (a) a gas inlet means for providing a waste gas stream to be oxidized; (b) a reactor for thermally oxidizing the waste gas stream; (c) an exhaust means for releasing the oxidized gas from the reactor; (d) a means for connecting the gas inlet means to the reactor; and (e) a means for connecting the reactor to the exhaust means; the improvement comprises at least one flow distribution means positioned between the gas inlet means and the exhaust means, said flow distribution means having at least one catalytically-active surface and being positioned in a manner such that said catalytically-active surface contacts the waste gas stream and oxidizes the oxidizable substances in the waste gas steam, wherein said at least one catalytic-active surface has a surface area, S, such that when the volumetric flow rate of waste gas passing through the flow distribution means is Q, the ratio of Q/S is at least 0.025 ft./sec. and wherein the flow distribution means is at least one device selected from the group consisting of turning vanes, flow mixers, flow straighteners and flow diverter devices.

2. An apparatus according to claim 1, wherein the catalytic-active surface is a catalyst coated onto the surface of the flow distribution means.

3. An apparatus according to claim 1, wherein the catalytic-active surface is provided by forming the flow distribution means from a metal having catalytic activity.

4. An apparatus according to claim 3 wherein the metal has been chemically-treated to provide catalytic activity.

5. An apparatus according to claim 3 wherein the metal has been thermally-treated to provide catalytic activity.

6. An apparatus according to claim 1, wherein the reactor includes a burner for thermally oxidizing the waste gas stream.

* * * * *